US005809971A

United States Patent [19]

Svensson et al.

[11] Patent Number: 5,809,971

[45] Date of Patent: Sep. 22, 1998

[54] ENGINE AIR/FUEL RATIO CONTROL

[75] Inventors: Ulf Malte Svensson, Lerum; Ulf Johan Petersson, Tollered, both of Sweden

[73] Assignee: Aktiebolaget Electrolux, Sockholm, Sweden

[21] Appl. No.: 938,532

[22] Filed: Sep. 26, 1997

Related U.S. Application Data

[62] Division of Ser. No. 602,738, filed as PCT/SE94/00791 Aug. 29, 1994, Pat. No. 5,709,193.

[30] Foreign Application Priority Data

Aug. 27, 1993 [SE] Sweden ..... 9302769

[51] Int. Cl.[6] ..... F02M 7/12; F02P 1/00

[52] U.S. Cl. ..... 123/438; 123/149 D

[58] Field of Search ..... 123/149 A, 149 D, 123/436, 438, 599, 701

[56] References Cited

U.S. PATENT DOCUMENTS

| | | | |
|---|---|---|---|
| 3,942,501 | 3/1976 | Byles | 123/599 |
| 4,061,121 | 12/1977 | Macleod | 123/599 X |
| 4,368,707 | 1/1983 | Leshner et al. | 123/436 |
| 4,442,815 | 4/1984 | Ninomiya | 123/436 |
| 4,515,118 | 5/1985 | Haubner et al. | 123/417 X |
| 4,829,963 | 5/1989 | Oblaender et al. | 123/436 |
| 4,901,704 | 2/1990 | Safranek | 123/149 D X |
| 5,161,496 | 11/1992 | Matsushima et al. | 123/149 D X |
| 5,172,675 | 12/1992 | Kurosu et al. | 123/599 |
| 5,345,912 | 9/1994 | Svensson et al. | 123/438 |
| 5,479,909 | 1/1996 | Blakeslee et al. | 123/599 X |

*Primary Examiner*—Tony M. Argenbright
*Attorney, Agent, or Firm*—Pearne, Gordon, McCoy & Granger LLP

[57] ABSTRACT

A method and device for controlling the fuel and/or air supply to an internal combustion engine in the fuel section thereof, such as a carburetor or a fuel injection system, so that the mixture ratio (A/F ratio) is adjusted automatically to a desired level in response to various operational conditions. In a rotational-speed feed back regulating circuit, a feedback control unit which receives information on the rotational speed from the engine briefly adjusts an adjustment device to provide a brief change of the mixture ratio and, in connection with the brief A/F/ ratio change, a number of revolution times are measured. At least one revolution time refers to a rotational speed that is essentially unaffected by the A/F ratio change and at least one revolution time refers to a rotational speed that is affected by the A/F ratio change. On the basis of these revolution times, at least one difference in revolution times between affected and unaffected rotational speeds is computed. Based on this difference and on stored information, the control unit will, as the case may be, affect the adjustment means to change the A/F ratio in the desired direction.

4 Claims, 9 Drawing Sheets

$$\text{ROTATIONAL SPEED} = \frac{1}{\text{REVOLUTION TIME}}$$

* FUEL CUT-OFF DURING REVS. 96-99, AFFECTING NEXT CYCLE. EXAMPLE ACC. TO FLOW CHART, FIG.9.

* FUEL CUT-OFF DURING REVS. 96-99, AFFECTING NEXT CYCLE. EXAMPLE ACC. TO FLOW CHART, FIG.9.

$$\text{ROT. SPEED} = \frac{1}{\text{REV. TIME}}$$

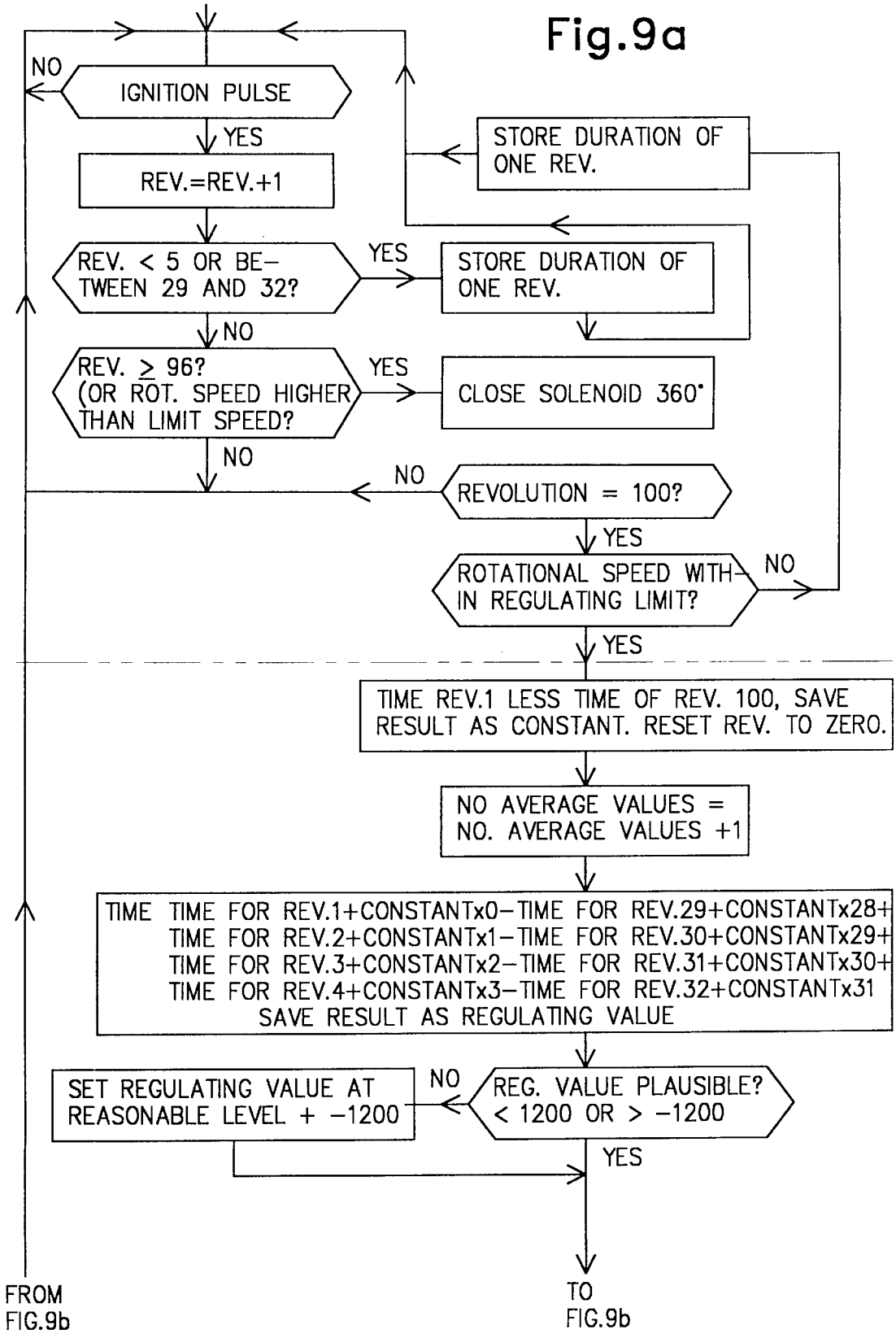
Fig.9a
IGNITION PULSE
NO
YES
REV.=REV.+1
REV. < 5 OR BE-TWEEN 29 AND 32?
YES
STORE DURATION OF ONE REV.
NO
REV. ≥ 96? (OR ROT. SPEED HIGHER THAN LIMIT SPEED?
YES
CLOSE SOLENOID 360°
NO
NO
REVOLUTION = 100?
YES
ROTATIONAL SPEED WITH-IN REGULATING LIMIT?
NO
YES
STORE DURATION OF ONE REV.
TIME REV.1 LESS TIME OF REV. 100, SAVE RESULT AS CONSTANT. RESET REV. TO ZERO.
NO AVERAGE VALUES = NO. AVERAGE VALUES +1
TIME TIME FOR REV.1+CONSTANTx0−TIME FOR REV.29+CONSTANTx28+
TIME FOR REV.2+CONSTANTx1−TIME FOR REV.30+CONSTANTx29+
TIME FOR REV.3+CONSTANTx2−TIME FOR REV.31+CONSTANTx30+
TIME FOR REV.4+CONSTANTx3−TIME FOR REV.32+CONSTANTx31
SAVE RESULT AS REGULATING VALUE
REG. VALUE PLAUSIBLE? < 1200 OR > −1200
NO
SET REGULATING VALUE AT REASONABLE LEVEL + −1200
YES
FROM FIG.9b
TO FIG.9b

ENGINE AIR/FUEL RATIO CONTROL

This is a divisional of application Ser. No. 08/602,738, filed as PCT/SE94/00791 Aug. 29, 1994, now U.S. Pat. No. 5,709,193.

TECHNICAL FIELD

The subject invention concerns a method and a device for controlling the supply of fuel and/or air to an internal combustion engine in its fuel supply section, such as the carburettor or the fuel-injection system, to ensure that its mixture ratio is automatically adjusted to the desired level in response to different operational conditions.

BACKGROUND OF THE INVENTION

In all internal combustion engines the air/fuel ratio is of utmost importance for the engine function. Usually the air/fuel ratio is referred to as the A/F-ratio, A and F signifying respectively air and fuel. In order to achieve a satisfactory combination of low fuel consumption, low fuel emissions, good runability and high efficiency the A/F-ratio must be maintained within comparatively narrow limits, compare FIG. 3. An A/F-ratio slightly on the lean side of the optimum position of efficiency is that usually sought after. The requirements that exhaust emissions from combustion engines be kept low are becoming increasingly stricter. In the case of car engines these requirements have led to the use of exhaust catalysers and to the use of devices of a kind known as lambda probes, to control the A/F-ratio. Such special transducers, i.e. oxygen sensors or lambda probes, are positioned in the car exhaust system. In this position they are able to detect the efficiency of the combustion and the results derived from the measurements made by the probe can be used in a control system to control the mixture ratio to provide a good result. The results from the oxygen sensor (lambda probe) is fed back to the fuel control system, eliminating the need for any further transducers.

However, the sensor or the probe requires a reference having completely pure oxygen, which is a situation that it is practically impossible to achieve in some engines, for instance the motors of power saws. In addition, control systems fitted with lambda probes are bulky and heavy while at the same time such systems are expensive and complicated and proned to entail operational safety problems in many applications. For instance, in a power saw, a system of this kind would result in increased size and weight as well as a drastic rise in costs and possibly also cause operational safety problems. The operational safety problems arise primarily because of the sensitivity of the unit and its wiring. This means that in the case of consumer products, such as power saws, lawn mowers, and similar products, this technology is difficult to use for mounting reasons and also for cost—efficiency and operational—safety reasons. Expected future legislation with respect to CO-emissions from small motors may make it difficult to use manually adjusted carburetors. Given the manufacturing tolerances that could be achieved in the case of carburetors it is impossible, with the use of fixed nozzles in the carburetor, to meet these legal requirements and at the same time guarantee the user good runability in all combinations of air-pressures and temperatures, different fuel qualities and so on. The desired mixture ratio, the A/F-ratio, is affected by many factors. From the Swedish Published Patent Application No. 468 998 is known a method and a device for controlling the carburetor of an internal combustion engine. This prior art control system comprises two regulating circuits. A first control unit essentially continuously affects an adjustment means to ensure that the mixture ratio is adjusted in response to a previously known rotational-speed dependency with respect to the mixture ratio, whereby the latter will be given a modified rotational-speed dependency. This means that the carburetor curve is corrected and such correction is an absolute requirement in the control operation.

However, to use two separate regulating ciruits to control the A/F-ratio naturally entails considerably complications and costs while at the same time it increases the error risks in comparison with the use of one single regulating circuit. However, it has been considered necessary to use two regulating circuits in order to achieve functionally efficient regulation.

PURPOSE OF THE INVENTION

The purpose of the subject invention is to considerably reduce the problems outlined above by providing a method and a device for controlling the fuel and/or air supply to an internal combustion engine in the fuel supply section thereof, such as the carburetor or fuel injection system, to ensure that its A/F-ratio is automatically adjusted to the desired level under different operational conditions. This purpose is achieved without the use of an oxygen sensor (lambda probe).

SUMMARY OF THE INVENTION

The above purpose is achieved in that the method and the device in accordance with the invention presents the characteristics defined in the appended claims.

Thus, the method in accordance with the invention is essentially characterized in that, in a rotational-speed feed-back regulating circuit, a feed back control unit receiving information on the rotaional-speed from the engine briefly affects an adjustment means to provide a brief change of the mixture ratio, and in that in connection with the brief A/F-ratio change a number of times of revolution are measured, the term time of revolution or revolution time being used herein to indicate the length of time of one revolution for instance by measuring, for each time of revolution, the duration between two successive ignition pulses, and at least one time of revolution referring to a rotational-speed that is essentially unaffected by the brief A/F-ratio change, preferably a rotational speed that is sufficiently early for the A/F-ratio change not to have had time to affect the rotatonal speed of the engine whereas at least one time of revolution refers to a rotational speed which is affected by the A/F-ratio change, and in that on the basis of these times of revolution is computed at least one difference in times of revolution between unaffected and affected rotational speeds and on the basis of this difference and of stored information the control unit, as the need may be, will affect an adjustment means to change the A/F-ratio in the desired direction towards a richer or a leaner mixture whereupon this procedure will be repeated in the rotational speed feed-back regulating circuit. In other words, the control is based on the time-of-revolution change that takes place in response to the analyzed brief A/F-ratio change and forms the basis for the change, if any, of the A/F-ratio in the desired direction. Generally speaking, it could be said that an increase of the rotational speed, i.e. shorter times of revolution, is an indication that the brief A/F-ratio change has resulted in an improved mixture ratio.

In accordance with a further development of the invention a number of measured revolution times are used, preferably about 4, which relate to engine speeds that are essentially unaffected by the brief A/F-ratio change whereas a number of revolution times, preferably around 4, relate to engine speeds that are affected by the change. On the basis of these revolution times a number, preferably 4, revolution-time differences between unaffected and affected engine speeds are measured. By using several difference values a kind of average value is computed, which provides a safer basis for the control.

In order to increase the safety further, revolution times are gathered from several different brief changes of the mixture ratio, which normally relate to brief leaner mixtures, i.e. a reduction of the ratio between the amount of fuel and the amount of air.

It is important that the revolution-time difference thus obtain actually is related to the change of the mixture ratio and not to a change of load or of acceleration. This could be established by using various correctional methods. One such method is to gather a number of revolution times, for instance all, and to band-pass filter the revolution-time values with respect to the frequency of change that they present. For a change of the mixture ratio results in a typical rapidity of change of the engine revolution times. The revolution-time changes exhibiting this rapidity or frequency are then accepted whereas revolution-time changes exhibiting higher or lower frequencies are separated by the filter.

The following detailed description of the various embodiments will make clear the manner in which the average value is established, as also the correction procedure, the plausability check and so on. The situation will be a great deal more simple to understand with the aid of flow charts and drawing figures. Further characteristics and advantages of the invention thus will be explained in the following description of the embodiments.

BRIEF DESCRIPTION OF THE INVENTION

The invention will be described in closer detail in the following by means of various embodiments thereof with reference to the accompanying drawings, wherein identical numeral references have been used in the various drawings figures to indicate identical parts.

FIG. 1*a* is a schematic view of a control system in accordance with the invention.

FIG. 1*b* is a flow chart showing the fundamental principle for control in accordance with the invention.

Figure 5:
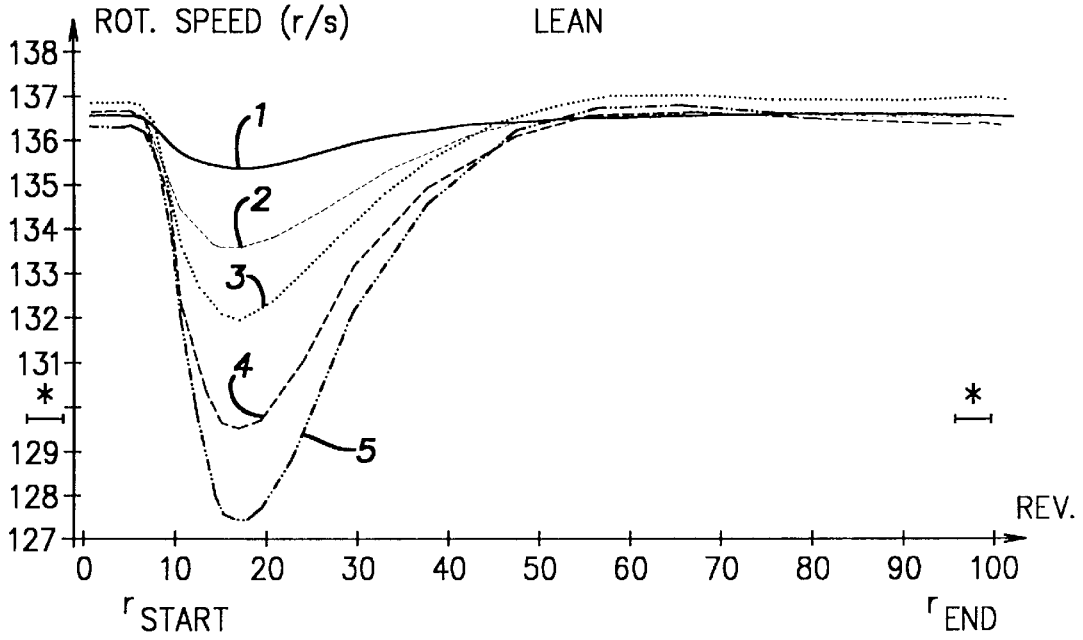

FIG. 5 illustrates the manner in which the number of revolutions, when the engine has a fundamentally lean setting, is affected by a brief change of the engine air/fuel ratio. Five different examples of brief changes are given. The changes refer to complete shut-off of the engine fuel supply during 1, 2, 3, 4 and 5 engine revolutions for each crank case scavenged, carburetor supplied two-stroke engine.

Figure 6:
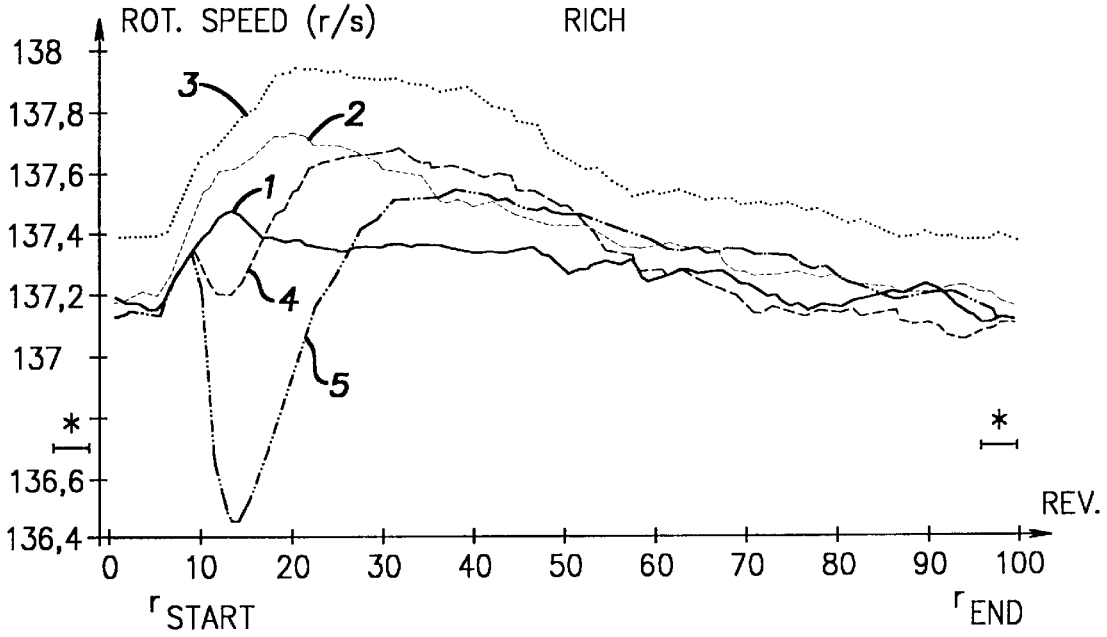

FIG. 6 corresponds completely to FIG. 5, with the exception that the engine setting is fundamentally on the rich side.

Figure 7:
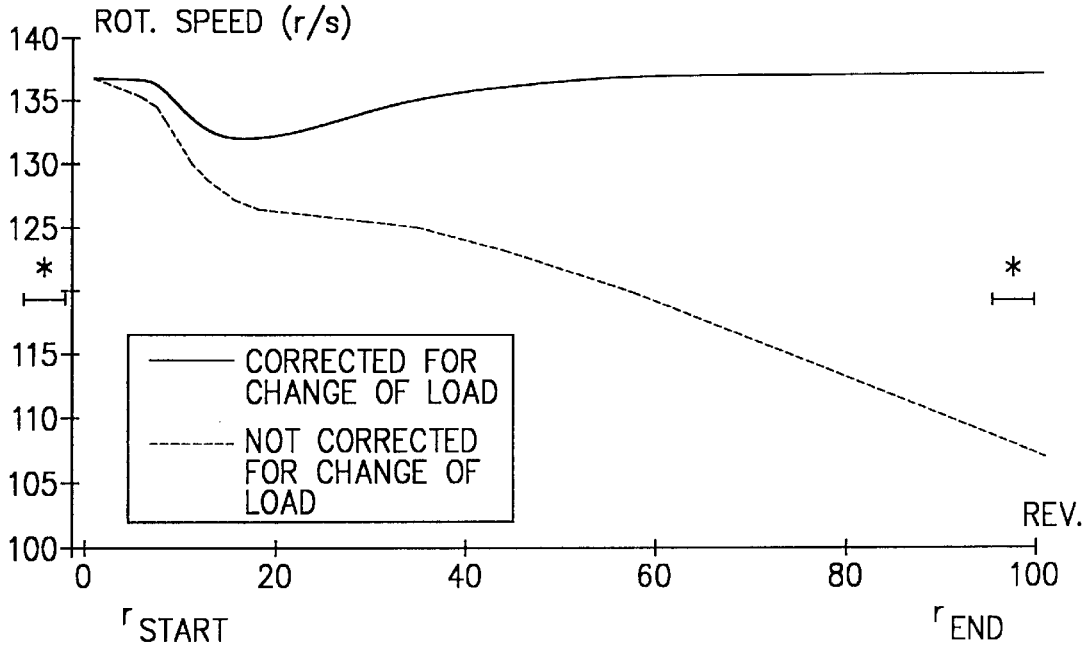

FIG. 7 illustrates by means of a dotted curve one example of changes in the number of revolutions in an engine which is affected on the one hand by brief changes of the air/fuel ratio and on the other by changes of load. By means of a continuous-line curve is shown the manner in which compensation for such change of load is effected, in principle, in the control system.

Figure 8:
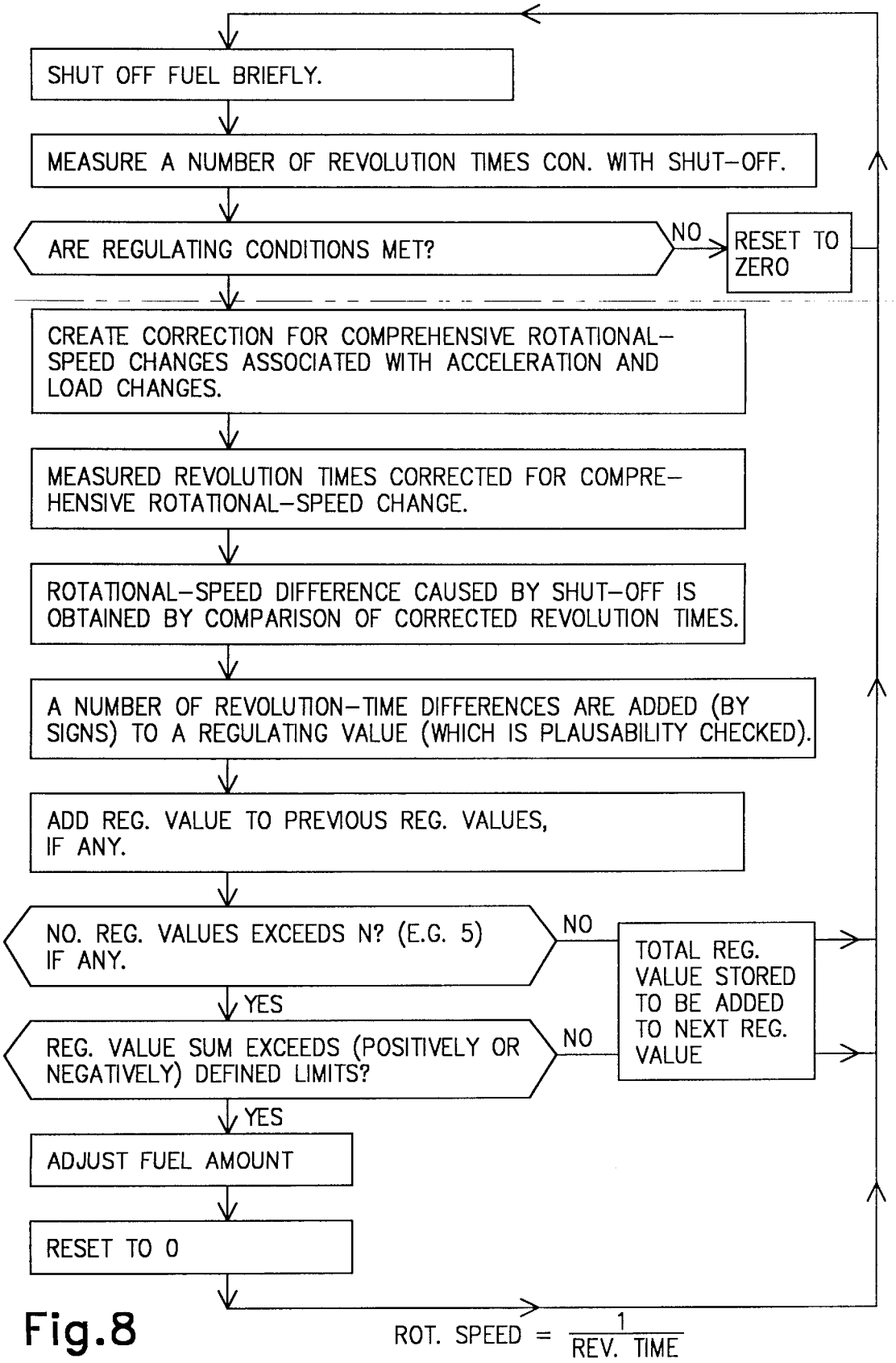

FIG. 8 is a flow chart indicating in principle the function of the control system in accordance with the invention.

Figure 9B:
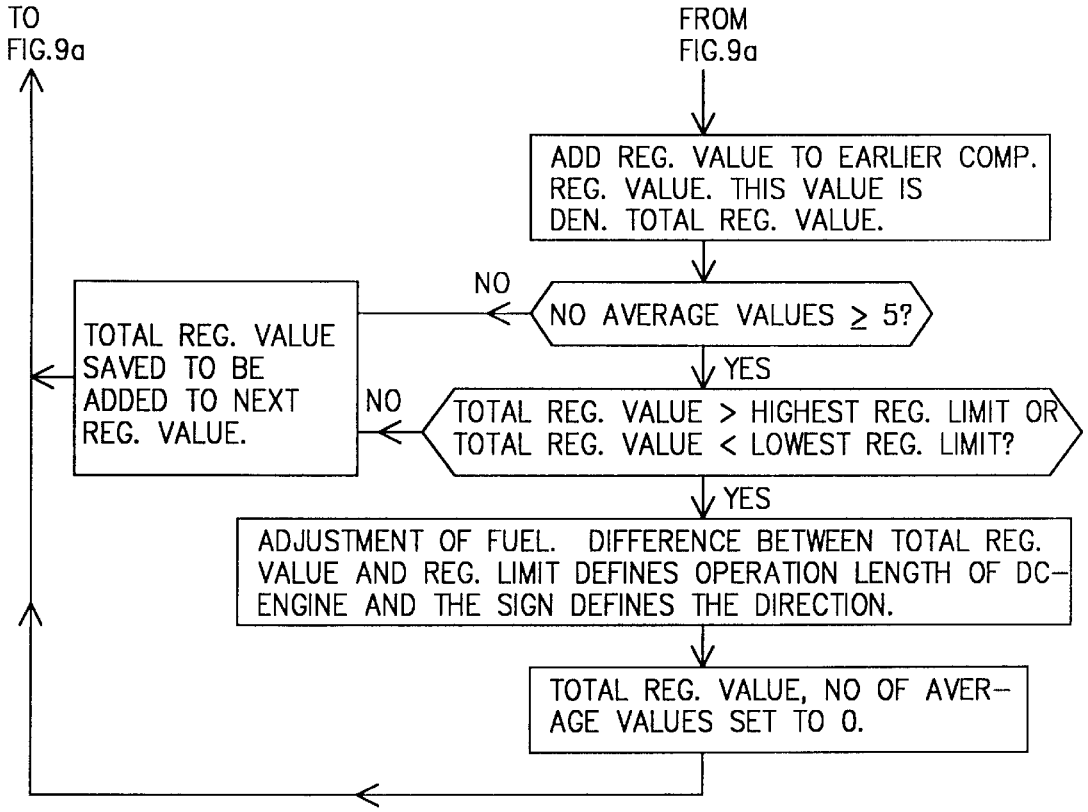

FIG. 9 is a more complete flow chart relating to a particular engine control situation. The control unit executes this flow cycle once for each revolution.

Figure 10:
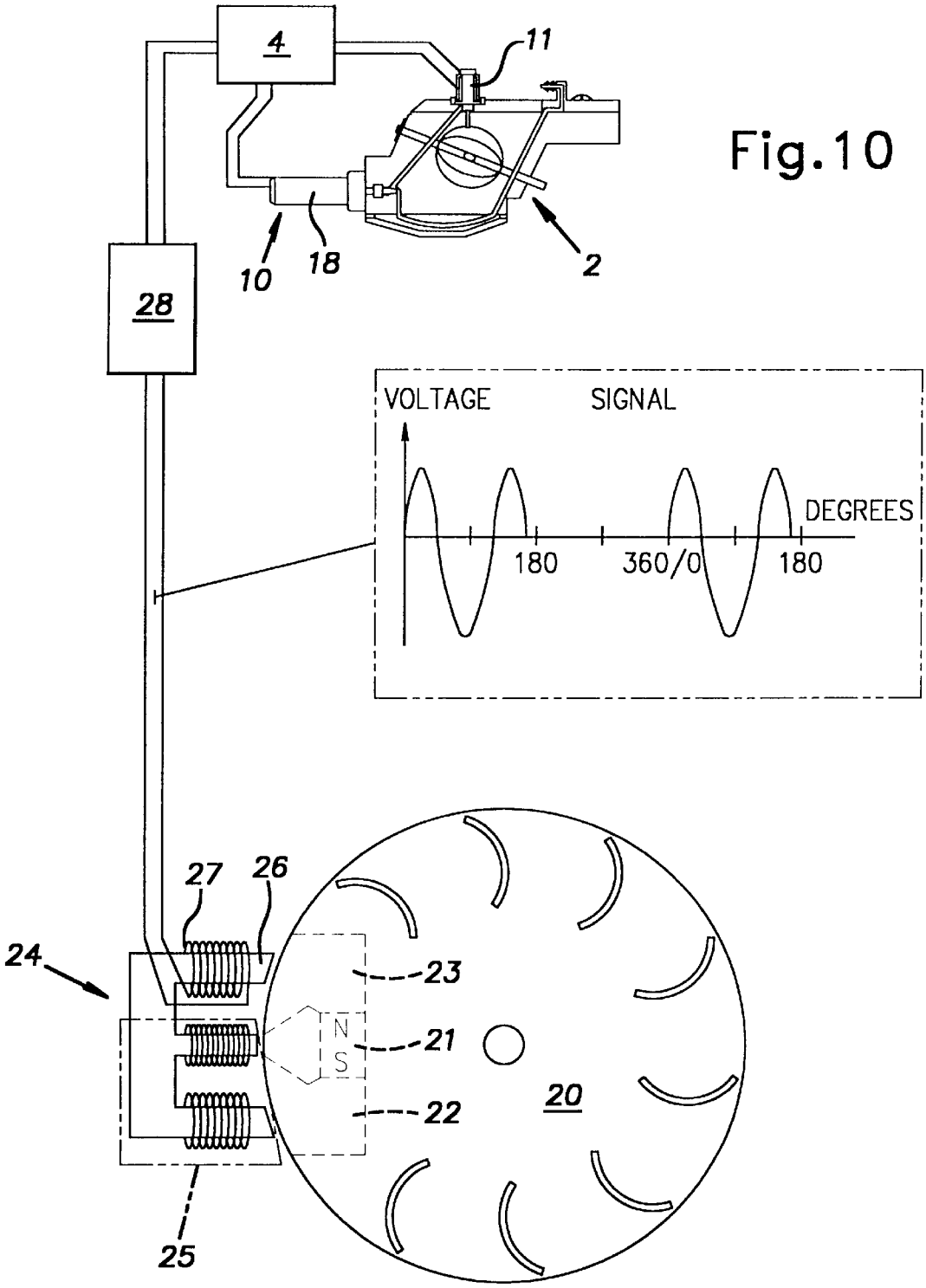

FIG. 10 illustrates the arrangement of the energitation of the control system.

DETAILED DESCRIPTION OF PREFERRED EMBODIMENTS OF THE INVENTION

Figure 1A:
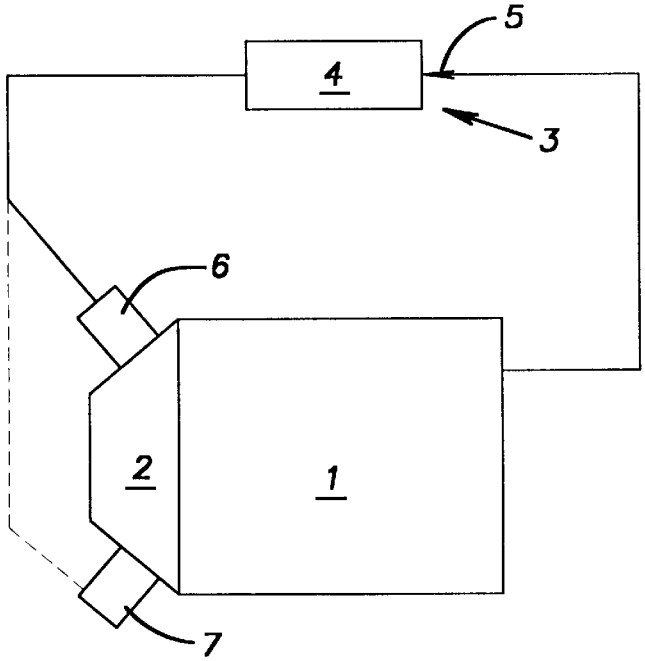

In the schematically rendered drawing FIG. 1*a*, reference numeral 1 indicates an internal combustion engine and 2 the fuel supply section of the engine. The fuel supply section could be e.g. a carburetor or a fuel injection system. Changes of the engine A/F-ratio normally take place by affecting the fuel supply to the engine. This may be effected by actuation of one or two setting or adjustment means 6, 7, assuming that the engine is a single-cylinder engine. Normally, each cylinder requires its individual setting means. In principle, the A/F-ratio could of course also be affected by means of the setting means 6, 7 affecting the air flow of the engine. From the engine 1, a control unit 4 receives information 5 indicative of the engine speed. The control unit 4 affects at least one setting means 6, 7. The control of the setting means 6, 7 by the control unit 4 thus is based on rotational-speed information received from the engine. In other words, the control unit 4 is incorporated in a rotational-speed, feedback regulating circuit 3.

In engines having a fuel injection system, the control unit 4 normally affects one injection valve for each cylinder. This injection valve may be placed directly inside the cylinder, for instance a diesel engine having direct fuel injection or could be placed adjacent the cylinder in a suction pipe or the like, or in a precombustion chamber. The examples refer to a gasoline-operated engine or a precombustion-chamber diesel engine. The control is effected by allowing the regulating unit 4 to briefly affect the injection valve, by briefly throttling the flow through the latter or by closing it briefly.

The manner in which the brief change of the fuel supply is effected depends highly on the type of engine concerned. In carburetor supplied crank case scavenged two-stroke engines the fuel has a long way to travel from the carburetor to the cylinder and considerable mixing takes place. The fuel supply to the carburetor may there be closed off over several engine revolutions. In an engine where the fuel is injected into the various cylinders there is no mixing effect. Shut-off of the fuel supply must in that case be of a considerably briefer duration, and perhaps take place only over a smaller portion of one revolution of the engine. It might also be possible to affect the mixture ratio by briefly throttling the fuel supply.

Figure 1B:
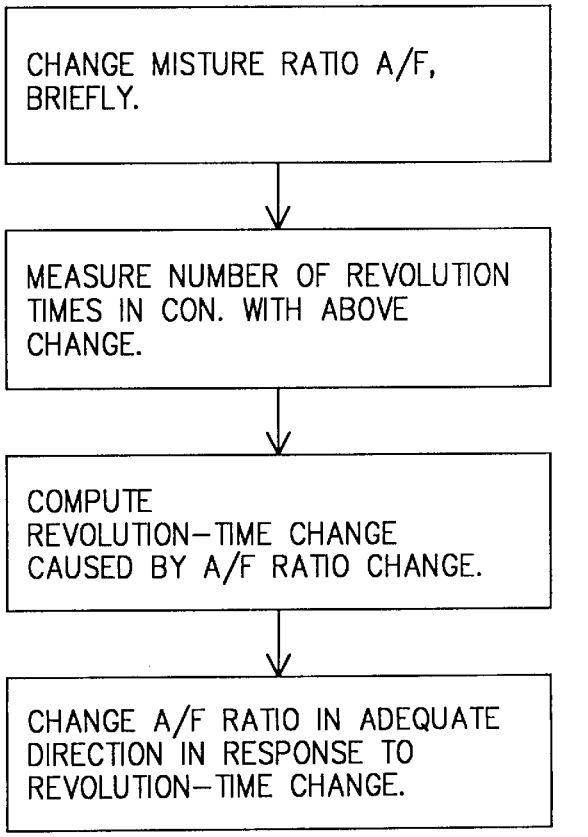

FIG. 1*b* illustrates the fundamental principle of controlling the engine air/fuel ratio. Initially, the A/F-ratio is changed briefly. This could be effected for instance by briefly throttling or stopping the fuel supply. In connection with the change, a number of engine revolution times are measured. The revolution times relate to engine rotational speeds chosen in such a manner that at least one revolution of the engine is unaffected by the change, preferably an engine rotational speed that is sufficiently early for the A/F-ratio change not having had time to affect the engine rotational speed, for instance one of revolutions 1–4 in FIGS. 5 and 6. In principle, also a later engine revolution, say between revolution 50 and 100 in FIGS. 5 and 6 could be chosen, but this would make it considerably more difficult to correct the revolution times to achieve the over all change of the rotational speed as indicated below. At least one revolution of the engine is chosen in such a manner that it is affected by the brief A/F-ratio change, for instance one of revolutions 20–40 in FIGS. 5 and 6. In this manner it becomes possible to compute a revolution-time difference caused by an A/F-ratio change. On the basis of this revolution-time difference a change, if needed, of the mixture ratio in the desired direction towards a leaner or richer mixture is made. Since the rotational speed equals 1/revolution time, it does not matter if the system operates on the basis of rotational speeds or revolution times.

Figure 2:
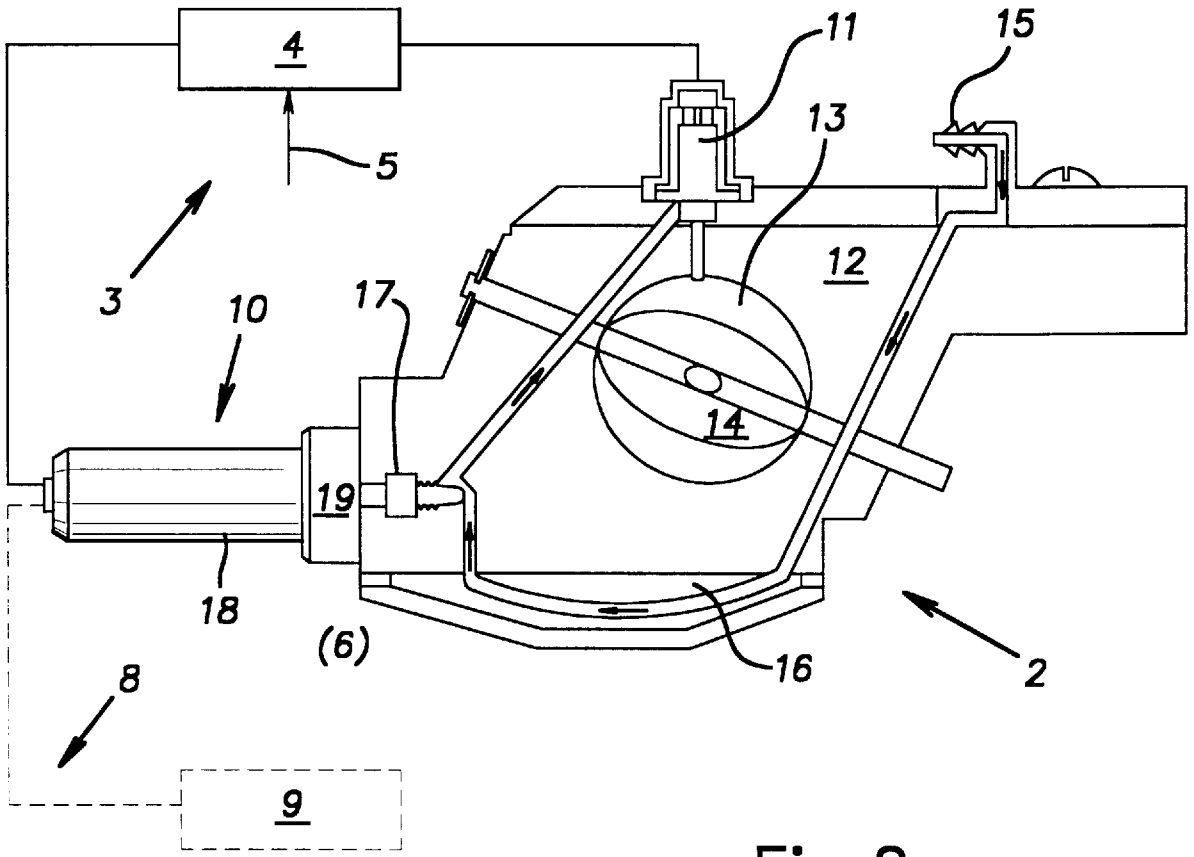
FIG. 2 is a cross-sectional view of a carburetor adapted to the control system of FIG. 1, the carburetor being seen in the direction of intake air and primarily being intended to supply a crank case scavenged two-stroke engine.

FIG. 2 is a cross-sectional view of a carburetor adapted to the control system in accordance with the invention. The control system is represented schematically. The control system illustrated in FIG. 2 is a particular embodiment among several conceivable ones. In order not to introduce any conflict between the general denominations concerning the setting means 6, 7 in FIG. 1 and the designations in FIG. 2 the particular setting means in FIG. 2 are referred to by numerals 10, 11.

The carburetor comprises a housing 12 having through flow channel 13 and the carburetor is seen in the air through-flow direction. In the through-flow channel is arranged a throttle valve 14 and, if needed a choke valve. In addition, the carburetor includes a fuel chamber or measuring chamber 16. The latter encloses a membrane regulating a fuel throttling means. The carburetor is a completely conventional membrane carburetor and for this reason will not be shown or commented upon in any closer detail. A fuel nozzle 15 forms the fuel inlet to the carburetor and by means of a pump the fuel is pumped to the fuel chamber 16. From the fuel chamber 16 the fuel is conducted past a throttling means, the throttling being caused by a metering rod 17. The metering rod is moved in its longitudinal extension to and fro by a DC-motor which displaces the metering rod 17 via a gear 19. From the metering rod 17 the fuel is carried to a shut-off solenoid 11. Thus it is a magnetic valve that closes the flow to the through flow channel 13 or allows it to pass. This thus is very simple and reliable magnetic valve of the on-off type. As previously mentioned, the fuel flows from the shut-off solenoid 11 further to the through-flow channel 13 into which it is injected unless the shut-off solenoid is closed. In principle, it would be possible to position both the shut-off and the throttle functions in the setting means 10. The latter then must be able both to close and to open the flow and to precision-regulate it.

The example of FIG. 2 primarily concerns a carburetor in a crank case scavenged two-stroke engine wherein the shut-off solenoid is closed over several revolutions of the engine. In a four-stroke engine briefer shut-off periods are used, since the dilution effect is considerably reduced in this case. For a brief shut-off of the fuel supply it is likewise possible to make use of the throttling effect controlled by the membrane of a membrane carburetor. In this case a pulsed valve momentarily lets through a depression, for instance from the engine crank case, resulting in a brief shut-off. Evidently, a vacuum pump may be used instead as the source of depression. It is likewise possible to make use of brief throttling of the total flow of fuel. If two setting means 6, 7; 10, 11 are used, one, for instance the closure solenoid 7; 11 could then briefly throttle the flow or briefly stop a part flow in the carburetor or the injection valve. If only one setting means (6; 10) is used, the latter should be throttled briefly once more. If a step motor is used to operate the metering rod 17 it could be advanced briefly a predetermined number of steps towards increased throttling and then be returned. When closure is desired it is on the other hand run over the number of steps required to effect closure and then it is run an equal number of steps backwards.

The control of the engine fuel supply could be described generally as follows. A more detailed description will be made in connection with the subsequent drawing figures in which are shown the basis for the control and the flow charts concerning the control. The feed-back control unit 4 briefly closes the fuel supply to the carburetor through-flow channel 13 by closing the shut-off solenoid 11. In the case under discussion i.e. a crank case scavenged two-stroke engine the shut-off solenoid is closed over one up to five engine revolutions, usually over three to four engine revolutions. The result is a change of the engine speed. In the case of a lean basic setting, this change appears from FIG. 4 and in the case of a rich basic setting of the engine, from FIG. 7. In other words, drawing FIGS. 5 and 6 each illustrate the rotational speed evolution in five different cases. The curve designated by numeral 1 shows the rotational speed evolution when the fuel supply is stopped over one engine revolution whereas curve 2 indicates the evolution when the fuel supply is stopped over 2 engine revolutions and so on. Control unit 4 receives information about the rotational speed 5 from the engine. In connection with the brief closure of the fuel supply, a number of revolution times are collected. These are selected in such a manner that some of them are unaffected by the fuel shut-off whereas some are affected thereby. By comparing the affected ones with the unaffected ones it becomes possible to compute the change of engine speed on the basis of fuel cut-off. Since a number of differences between unaffected and affected revolution times is used to bring about rotational-speed influence the process could be compared to the computation of an average value. The feed-back control unit 4 analyses the change of rotational speed and on the basis thereof and of stored information commands a change in the setting of the metering rod 17. The change is achieved in that the DC-motor 18, via the gear 19, displaces the rod 17 somewhat in the desired direction, i.e. to allow a smaller or a larger amount of fuel to pass through, in other words to establish a richer or a leaner mixture ratio A/F.

The control system in accordance with FIG. 2 could also be provided with an additional regulating circuit 8, as illustrated in dotted lines in that drawing figure. It comprises an extra control unit 9. There is no rotational speed feed-back in this regulating circuit and it is only used to effect adjustment of the carburetor curve. This appears in closer detail from FIG. 4 and will be commented upon in connection with that drawing figure. Generally, the additional regulating circuit is used to adjust the rotational-speed dependency of the A/F curve, for instance for fuel injection or carburetor engines.

Figure 3:
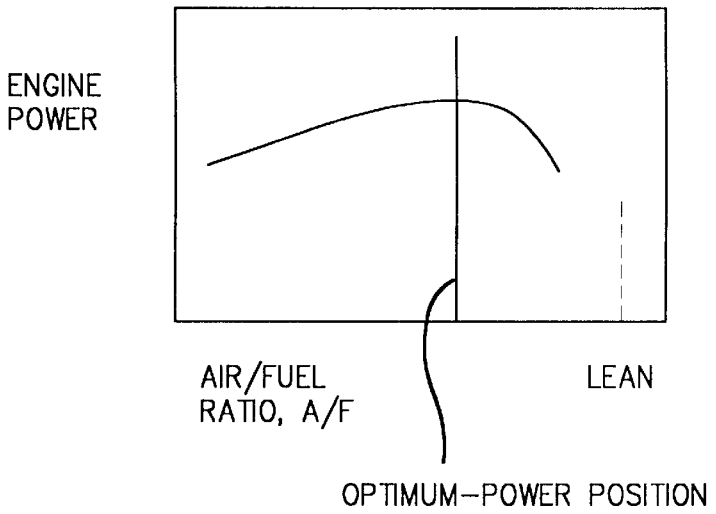
FIG. 3 is a diagram indicating the variation of engine performance in dependency of the air fuel ratio A/F.
Figure 4:
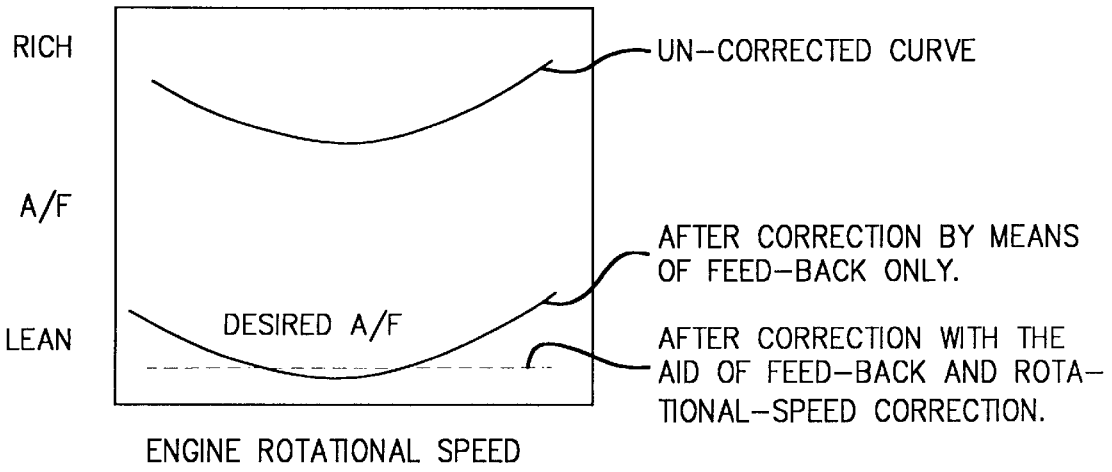
FIG. 4 illustrates the engine air fuel ratio A/F as a function of the number of engine revolutions in a carburetor engine.

FIGS. 3 and 4 illustrate the bases of the control of the carburetor-supplied combustion engine in accordance with FIG. 2. FIG. 3 illustrates the engine power variations in response to various air-fuel ratios. An optimum-power position is marked at the peak of the performance curve. In other words, the engine power is lowered both in case of a mixture that is richer and leaner than that producing optimum power. Normally, an air-fuel ratio somewhat on the lean side of the optimum-efficiency position is desired, and the reason therefor is to achieve a good combination of fuel economy and high power.

FIG. 4 illustrates the variation of the air-fuel ratio in response to the engine rotational speed in a normal membrane-carburetor. The uppermost depression-shaped curve illustrates a so called "non-corrected curve", wherein no correction by the control system has been made. The A/F-ratio curve is on the fat or rich side. The desired A/F-ratio is a horizontal line, illustrated by a dotted line, somewhat more towards the lean side. The rotational-speed feed-back regulating circuit 3 lowers the A/F curve to the desired level. Owing to its shape, it will partly deviate from the ideal A/F-ratio value. In drawing FIG. 4 this curve is indicated, "After correction by means of feed-back only". This control has proved to work well in two-stroke power saw engines. This is surprising, since it has previously always been considered necessary to "flatten out" the A/F-ratio curve in order to achieve a satisfactory result. The additional regulating circuit 8, indicated by dash-and-dot lines in FIG. 2, is used precisely for such flattening out situations. With the aid of the additional regulating circuit the ends of the un-corrected curve are "dipped", giving an essentially straight line after correction. In the case of control with the aid of regulating circuits 3 and 8 it does become possible to achieve the curve following the straight dotted line, i.e. the desired A/F-ratio. In the drawing figure this is indicated, "After correction with the aid of feed-back and rotational speed correction".

FIGS. 5 and 6 have been discussed generally in the aforegoing and will be elucidated in closer detail in accordance with the flow chart of FIGS. 8 and 9.

Drawing FIG. 7 illustrates the taking into account of a change of charge or of acceleration occurring at the same time as the brief change of the mixture ratio. The dotted-line curve illustrates a typical rotational-speed evolution in an engine affected by a change of charge and a temporary change of the mixture ratio. It could be for instance a power saw which experiences an increased resistance and as a consequence thereof a drop in the rotational speed, i.e. "comprehensive rotational speed change". Owing to the brief change of the mixture ratio, normally a leaner mixture, the rotational speed drops by an excessive amount within the area of approximately revolutions 10–25. This is translated as an additional dip in the smooth slope downwards. If instead the acceleration had been increased under constant-load conditions, the curve would have been given an upwards tendency with a dip related to the brief change of the mixture ratio. The example in drawing FIG. 7 corresponds to a lean basic setting of the engine in accordance with FIG. 5. Changes of load or acceleration thus results in a lengthy or comprehensive rotational-speed change, as opposed to the brief one caused by the brief change in the mixture ratio. The comprehensive rotational-speed change must be considered in the analysis of the rotational-speed change in connection with the brief change of the mixture ratio. Drawing FIG. 7 illustrates one method of effecting a correction of this kind.

The correction has been made by comparing rotatational speeds of revolutions 100 and 1. Thereafter, the rotational speed of revolution 100 is increased up to the same level as the rotational speed of revolution 1. The values of this increase or correction are added thereafter in a linearly varying degree to other revolutions, that is to revolution 50 is added the value of half the correction, to revolution 20 a fifth of the value thereof and so on. These corrections produce the continuous-line curve which is corrected for change of load or change of acceleration. It corresponds well to the curve which contrary thereto would have been received, had the engine been exposed to constant load and acceleration and had been exposed to a brief change of the mixture ratio. In this drawing figure $r_{start}$=revolution 1 and $r_{end}$=revolution 100 are indicated. The rotational-speed difference between $r_{start}$ and $r_{end}$ thus is translated into a correction signal and the latter is added to a varying degree to the other revolutions. The proportion of full correction then is $(r-r_{start})$ divided by $(r_{end}-r_{start})$. Thus, $r_{end}$ is fully corrected and is transferred to the same level as $r_{start}$, which value does not, however, contain any correction, and r=50 receives approximately half the correction. Obviously, a larger number of rotational speeds could be used to provide some kind of average or mean value, in which case for instance $r_{start}$ could comprise revolutions 1–4 and $r_{end}$ revolutions 97–100.

Another way of correcting the revolution times is by band pass transformation or "band pass filtering" the revolution times with regard to the change frequency they exhibit. This means that band pass filtering occurs in the frequency plane. The dotted curve is then transformed by means of a filter of this kind, ensuring that only revolution-time changes, or rotational-speed changes, having approximately the expected speed or frequency, pass uneffected. In the case of lower frequencies, such as those occurring owing to changes of load or of acceleration, a transformation occurs, such as these oscillations are "dampened out", for instance by a 20× damping factor. The result is approximately the continuous-line curve in FIG. 7. In case the dotted-line curve had also contained a high "disturbance frequency", for instance a measurement disturbance, the latter would also have been "dampened out", owing to the band pass transformation. The band width could of course also be chosen so as not to "dampen out" high frequencies in question, i.e. more the character of a high pass filter. Because only transformation of the revolution-time curve has been made, all revolution times remain. This means that other parts of the control program could be identical to those used with respect to the correction method described earlier. The two correction methods could also be combined.

FIGS. 8 and 9 are flow charts relating to a control system in accordance with the invention. In a more general way, FIG. 8 shows the total control process while in a more complete manner FIG. 9 illustrates a flow-chart cycle run through once for each engine revolution by the control unit 4. Both are based on an engine application that is quite demanding from a control point of view since they both relate to the control of a power saw engine. Its operational conditions are characterized by rapid load variations and rapid acceleration changes. This leads to frequent variations of the rotation speeds. In many other engine applications such variations are very unfrequent, for instance in the case of aircraft and ship engines. The power saw engine is a two stroke engine of the type that is carburetor supplied and crank case scavenged. This means that the brief change of the mixture ratio, i.e. the A/F-ratio, preferably is effected by means of a brief shut-off of the fuel supply over several engine revolutions. More generally, this change could instead be achieved by temporarily throttling the fuel supply or even by actuating the air supply to the engine. In summary this means that in a more general operational application, particularly in applications that are more simple from an operational point of view, the flow chart could exhibit a more simple appearance than that in FIGS. 8 and 9 and be more similar to that according to FIG. 1*b*. It might then not be necessary to provide for correction of the comprehensive rotational-speed change and to correct measured revolution times. In a more "simple" case a lesser number of rotational-speed differences could be used for the control purposes and the need for a plausability check is reduced.

In view of the above, the flow charts of FIGS. 8 and 9 will be followed, the summarizing chart according to FIG. 8 serving as an introduction to simplify the understanding of the chart in accordance with FIG. 9. The first box in FIG. 8 relates to "shut-off fuel briefly". The shut-off applies to engine revolutions 96, 97, 98 and 99 in the cycle preceding the discussed one. Compare FIGS. 5–7. The next box is labelled "measure a number of revolution times in connection with shut off". In this case the revolution time is measured for revolutions 1–4 inclusive and revolutions 29 to 32 inclusive and these revolution times are stored in the memory. In connection with the shut off during revolutions 96–99 inclusive in the preceding cycle thus four earlier revolutions 1–4 are measured as are also four later revolutions 29–32 in the discussed cycle. The revolutions 1–4 inclusive have been chosen because here the rotational speed still is unaffected by the shut-off of the fuel supply just effected. It should be noted, that in FIG. 5, the fuel shut-off during revolutions 96 to 99 inclusive is indicated, which corresponds to flow chart 9. On the other hand the drawing figures also indicate the rotational speed evolution upon fuel shut-off also during revolutions 1, 2, 3 and 5.

The next box in the flow chart, FIG. 8 is, "Are regulating conditions met?". At this stage there is only one condition to be met, viz. to establish whether the rotational speed is within the regulating limit, in this case 150–200 rps, i.e. 9000–12000 revolutions per minute. If this is the case, the program is run through further in the direction towards adjustment of the A/F-ratio. If this is not the case, revolutions and revolution times are reset to zero, i.e. the measured revolution times are dumped. The process is run through again and this continues until the rotational speed is within the regulating limit.

Reference is now made to corresponding part of the more complete flow chart shown in FIG. 9. This program is run through once per revolution and entrance is affected at box "ignition pulse?". An iginition pulse signal is required to establish revolution times. When an ignition pulse signal has been received revolutions are upvalued by addition of one unit. In the next box, "revolution below 5, or between 29 and 32?" eight revolutions are selected so that their revolution times may be measured and stored. This means that in the case of revolution 1 the answer will be YES and its revolution time will be stored. The process is again run through, whereby revolution times concerning revolutions 2, 3 and 4 are stored. The answer thereafter will be NO. The next box is entitled, "Revolution≧96?". In this box the answer is NO with respect to revolutions 5–28, with the result that the preceding boxes will be run through again. When the revolution is number 29 the time associated therewith will be stored as also that of revolutions 30, 31 and 32. With respect to revolutions 33–95 the program runs down through the four first boxes without any measures being taken. When the revolution is number 96, the solenoid is closed over 360°, i.e. one engine revolution. The next box "Revolution=100?" gives the answer is NO with respect to revolutions 96, 97, 98 and 99. When the answer is NO the preceding part of the flow chart is run through, whereby the solenoid will be maintained closed during the corresponding four engine revolutions. When the revolution is number 100 the next box will be, "Rotational speed within regulating limit?". In this case, the regulating limit is 150–200 r.p.s., i.e. 9000–12000 revolutions per minute. When the answer is NO revolutions and revolution times are reset to zero, whereby measured revolution times are dumped and the process restarts. At this point the first part of the two flow charts down to the dotted line has been run through.

Immediately below the line in FIG. 8 appears the box entitled, "create correction for comprehensive rotational-speed changes associated with acceleration and load changes". This process has been commented upon earlier in connection with drawing FIG. 7. In drawing FIG. 9 the corresponding situation appears under box "Time revolution 1 less time of revolution 100, save result as constant. Reset revolution to zero". When revolution 100 has been used, revolution thus is reset to zero. This means recount of revolutions 0, 1, 2 and so on. A new cycle thus will start when the on-going one has ended further down in the chart. In the same manner the new cycle comprises collection of a number of revolution-time data and shut-off of fuel supply (solenoid) over four engine revolutions. In this case a cycle period of 100 engine revolutions has been chosen, since the engine rotational speed has had time to stabilize at this point after the brief change of the mixture ratio. This cycle period is a suitable one for the intended application of the engine under discussion. As previously mentioned, full correction should be added to revolution 100, i.e. the final revolution, $r_{end}$. Preferably, the revolution-time differential between revolution 1 and revolution 100 divided by 100 is saved as a constant. Consequently, the constant need later only be multiplied by the intended engine revolution, i.e. an engine revolution between 1 and 100. In the following box the number of average values are upvalued by one unit. By average value is in this case intended each cycle or the interval of revolutions 0 to 100.

The following box in drawing FIG. 9 relates to the computation process in order to obtain a so called regulating value. This computation corresponds to three different boxes in drawing FIG. 8, with the exception of the plausibility check in the last box. The three boxes are "Measured revolution times corrected for comprehensive rotational-speed change".

"Rotational-speed difference caused by shut-off is obtained by comparison of corrected revolution times".

"A number of revolution-time differences are added (by sign) to a regulating value (which is plausability checked)".

In the computing box in FIG. 9 revolution 1+constant× zero is timed first. Zero results, because r for revolution 1=$r_{start}$. This means that ($r-r_{start}$) divided by ($r_{end}-r_{start}$) is zero. From this uncorrected revolution time concerning revolution 1 is substracted the time (duration) concerning revolution 29+constant×28. In this case, the correction becomes just over 28% of full correction. The first row thus is the revolution-time difference between an early revolution and a late revolution with respect to the A/F-ratio change. This is a difference between two corrected revolution times which are a measure of the revolution-time change caused by the A/F-ratio change. To this value is added a new revolution-time difference between an early revolution and a late revolution, viz. revolution 2 and revolution 30, both revolution times having been corrected. In the same manner the difference with respect to revolution 3 and revolution 31 are added and the difference is added with respect to revolution 4 and revolution 32. The total sum of these four revolution time differences including corrections is stored as a regulating value.

The next step is a plausability check. A particular routine has been created for this check in the chart according to FIG. 9. "Regulating value plausible? less than 1200 or exceeding −1200". In other words, the regulating value is checked to ensure that it lies between an upper and a lower limit. If the answer is NO, the regulating value is set to a plausible level, i.e. the closest limit (+ or −1200). Obviously, it will also have been possible to just dump a regulating value outside the limits indicated. However, the improved function is obtained if instead the regulating value is set to a plausible level. In the present case a regulating value within the limits is excepted or else it is set to the value of the closest limit.

In drawing FIG. 9, box "Add regulating value to earlier computed regulating value. This value is denominated total regulating value", follows. A corresponding box occurs also in FIG. 8. Each regulating value is associated with a certain brief change of the mixture ratio. By adding together several regulating values a computation of some kind of average values is made from several different changes of mixture ratios. In the following box the question is raised whether the number of regulated values exceeds n (example 5). This means that the number of average values is conditional, i.e. the number of regulating values included in the total regulating value. The larger the number of regulating values, the safer the average value computation. This is the idea behind the claim. When the number of average values is less than 5 the total regulating value is stored to be added to the next regulating value. The next regulating value is obtained when the hitherto part of the chart has been run through once more.

On the other hand, when the total regulating value contains more than 5 regulating values a comparison is made between its size and certain limits values in box "Total regulating value>highest regulating limit or total regulating value<lowest regulating limit?". Since the regulating values and the total regulating value also contain signs it is important that these two limit values be compared. A positive total regulating value thus should exceed the highest regulating limit whereas a negative total regulating value should be less than the lowest regulating limit. For example, in the present case the highest regulating limit is set to 1500 and the lowest regulating limit to −750. If the total regulating value does not exceed either of the given limit values the total regulating value is stored to be added to the following regulating value and the process is run through again to add another regulating value to the sum.

If on the other hand a total of regulating value exceeds the nearest limit value, the answer is YES. This leads to box "Adjustment of fuel. Difference between total regulating value and regulating limit defines operational length of DC-engine and the sign defines the direction". In this case a comparison is made between the difference between the total regulating value and the nearest regulating limit. The sign of the difference defines in which direction the adjustment is to be made. Thus, the adjustment is made in the direction towards a more suitable mixture ratio, richer or leaner. Obviously, this is important in order to obtain a well functioning regulating process. The difference size defines the length of the engine operation, that is the amount of adjustment required. The result is some kind of need-control adjustment, which is an advantage, although not completely necessary. For example, instead an adjustment by a predetermined amount in the right direction could be made. In this case, an adjustment of the fuel amount has been made, i.e. an adjustment of the A/F-ratio. Thereafter, the total regulating value and the number of average values are set to zero. The number of revolutions have already been set to zero. The process is then repeated.

The fundamentally important principles of the control is on the one hand to provide safety through average-value computation and on the other to correct for comprehensive rotational-speed changes and on the other to perform a plausability check. The average-value computation is effected in several steps. Firstly, four different difference values between different revolution times within each cycle, i.e. engine revolutions 0–100 are used. Then at least five regulating values are added before a comparison is made with predetermined regulating limits. Each regulating value is associated with one cycle and its input regulating times are corrected for comprehensive rotational-speed changes. The number of regulating values that are compared with the regulating limits thus is not fixed upwards. This means that when the engine is running well, i.e. has a suitable A/F-ratio, a large number of regulating values, for example 10, probably are required before the total regulating value exceeds a regulating limit. In this case, it is also likely that the excess is moderate. This means that a small adjustment of the fuel amount is made because the DC-engine is run for a short period. On the other hand, if the A/F-ratio value is not very satisfactory each regulating value will be high and already at five regulating values the total regulating value highly exceeds the regulating limit. This means that a large correction is effected in the right direction. The examples clearly show the advantages of this control philosophy.

It is comparatively simple to integrate an over-rev engine protection with the A/F-ratio control system. The reason therefore is that all necessary equipment to control the rotational speed already is at hand. The control unit 4 receives all rotational-speed information 5 from the engine and can actuate an adjustment means 6, 7; 10, 11 in such a manner that the fuel supply to the engine is throttled. What is required is merely a routine in the control program to limit the engine rotational speed. In the flow chart of FIG. 9 this routine is inserted in the fourth box from above i.e. "Revolution≧96? (or is rotational speed higher than the limitation speed?)". The parenthesis thus refers to the part connected with the over-rev protection. This part preferably is included in the A/F-ratio control but naturally must not be so. When the rotational speed is higher than the limitation speed the solenoid is closed over 360°, i.e. over one revolution of the engine. The question in the following box "Revolution=100?" and as a rule the answer is NO and the hitherto portion of the flow chart is run through again. Again, if the rotational speed is higher than the limitation speed the solenoid is kept close for another revolution of the engine and in this way the procedure continues until the rotational speed no longer is higher than the rotational limitation speed. When the revolution is=100, the next box is, "Rotational speed within regulating limit?" and the answer will be NO and revolutions and revolution times are reset to zero and the hitherto portion of the program is run through again. Consequently, this means that the solenoid is kept closed until the rotational speed no longer is higher than the limitation speed. If the revolution time is within the regulating limit at revolution 100 the control process proceeds towards a regulation of the A/F-ratio as described before.

The flow chart of FIG. 9 concerns a carburetor supplied two-stroke power saw engine. Generally speaking, the various values concerning revolutions and limit values obviously are different. Generally, the rotational speed limitation is affected through throttling of the fuel supply, which throttling could differ in magnitude for various applications. Totally speaking, this means that the over-rev protection function is integrated in a very simple and efficient manner in the A/F-ratio control system. The over-rev protection function is obtained without any direct costs having been incurred.

The A/F-ratio control in the fuel supply part requires operational energy. FIG. 10 shows a typical application, viz. the carburetor control in accordance with FIG. 2. In this case, the fuel supply is briefly cut off with the aid of the cut-off solenoid 11. Normally, this happens over four engine revolutions per interval of 100 revolutions, that is over 4% of the time. Consequently, the solenoid is a magnetic valve that normally is open and which is closed when energized for about 4% of its operational time. In the power saw application under discussion the solenoid requires approximately 5 W for closure. The adjustment of the A/F-ratio is affected by means of the setting means 10. A DC-motor 18 actuates a regulating rod which brings about the desired throttling of the fuel flow. The DC-motor consumes energy only during adjustment of the throttling. In the power saw application in accordance with FIGS. 2 and 9, this adjustment occurs every 500 revolution at most. Also when the adjustment takes place slowly the adjustment time usually will definitely be less than 1% of the operational time. During adjustment, the DC-engine requires about 1 W. In addition, this control program is conceived to ensure that adjustment with the aid of the DC-engine does not take place while the solenoid is activated. The control unit 4 consumes extremely little energy, which is almost negligible compared with that of the shut-off solenoid 11 and the DC-engine 18.

The energizing system illustrated in FIG. 10 is primarily intended for a carburetor supplied two-stroke power saw engine but naturally it could also be used for a similar internal combustion engine of a two-stroke or a four-stroke type or any other type, provided it does not have a generator or battery system, which is however common in larger engines. The statements made earlier as regards the fuel supply to the carburetor or the fuel injection system applies also to the subject energizing system. If one single setting means is utilized in the control system it could be energized in the same way, provided that its energy consumption is sufficiently low.

In FIG. 10 numeral 20 designates a fly wheel intended for example for the engine of a power saw. The fly wheel has curved blades and some of them have been eliminated for reasons of clarity. A cast-in permanent magnet 21 including north and south poles is surrounded by iron cores 22, 23. An integrated unit 24 for the ignition system and energy supply of the control system is positioned at the periphery of the fly wheel. The portion 25 which is surrounded by a frame is intended for the engine ignition system and is of a completely conventional construction. It comprises one primary and one secondary coil which coils are positioned each on its associated leg of an iron core and in addition it contains control electronics. Upon rotation of the fly wheel portion 25 gives energy to the ignition system spark plugs. Portion 25 normally comprises an iron core having two legs to support the ignition system coils. However, in this case the iron core has been lengthened and given a third leg 26. The latter leg is provided with its own or an additional coil 27, the two wire ends of which lead to an energy storing unit 28. Unit 28 comprises a condenser for energy storage and electronic units for transformation of the voltage signal from AC-voltage to DC-voltage and to smooth the signal. The energy storage function is an important one, since the control system requires "high" power only briefly. For instance, the shut-off solenoid alone requires about 5 W. On the other hand coil 27 only supplies about 3 W which would have been insufficient without the energy storage unit 28. The diagram in the drawing figure illustrates the voltage signal to unit 28. In the unit it is transformed to a DC-voltage signal which is used to drive the shut-off solenoid 11, the DC-engine 18 and the control unit 4. The DC-voltage signal reaching the control unit 4 is used also for trigging purposes, i.e. as rotational-speed information. It should be noted, that both ends of the coil 27 lead to the energy storage unit 28. In other words, coearthing of the coil 27 and the ignition system coils has been avoided. This gives a clearer input signal to the energy storage unit 24 and further to the control unit 4.

The novel feature of the current supply system thus is that the current is derived from a completely separate coil which is integrated in the ignition system module. This is so, because it is placed on a third leg of the iron core. In addition, the entire unit is cast into a plastic compound and screwed in position. The existing magnetic system in the fly wheel is used. This means that a simple and reliable solution is provided at low cost. Because the extra coil 27 is completely separate from the coils of the ignition system the level of disturbance of the signal to the control system is low. The control system and the current supply system are mutually tuned in several ways. The control system is conceived to require but little energy. In this manner a simple, reliable and cheap current supply device may be used. And in addition this is conceived to provide a low level of disturbance in the current supply function. In addition the current supply device also serves to provide rotational speed-information to the control unit.

We claim:

1. A device for controlling at least one of a fuel supply and an air supply in an internal combustion engine (1), in a fuel supply section (2) thereof, such that an A/F-ratio is automatically adjusted to a desired level during different operational conditions, wherein the device comprises a control unit (4) which is connected to at least one adjustment means (6, 7; 10, 11) by means of wires, said at least one adjustment means being arranged to affect the A/F-ratio by adjusting the amount of fuel in the engine fuel supply section, and wherein, by means of a number of wires, the control unit (4), is connected to an extra coil (27) which is positioned on an extra leg (26) of an iron core, said core and said extra coil (27) being provided by an integrated unit (24) for an ignition system and energy supply of the control system, said control unit (4) receives voltage pulses from said coil which are utilized to energize the control unit (4) and the adjustment means (6, 7; 10, 11) and to receive rotational speed information (5) to allow computation of revolution times.

2. A device as claimed in claim 1, wherein the control unit (4) is connected to first and second adjustment means (6, 7; 10, 11), said first adjustment means comprising a shut-off solenoid (7; 11) which is operable to briefly close at least a portion of the fuel flow, and said second adjustment means comprises a throttle valve (6; 10), said throttling valve being operable to open and close, in response to the control unit (4) to provide a desired degree of throttling to produce the desired A/F-ratio.

3. A device as claimed in claim 1, wherein an energy storage unit (28) is coupled between the extra coil (27) and the control unit (4) and the energy storage unit (28) contains at least one battery for energy storage purposes and means for converting an AC-signal into a DC-signal.

4. A device as claimed in claim 2, wherein an energy storage unit (28) is coupled between the extra coil (27) and the control unit (4) and the energy storage unit (28) contains at least one battery for energy storage purposes and means for converting an AC-signal into a DC-signal.

* * * * *